US012207774B1

(12) United States Patent
Xu et al.

(10) Patent No.: US 12,207,774 B1
(45) Date of Patent: Jan. 28, 2025

(54) CLEANING DEVICE, FLOOR BRUSH ASSEMBLY AND INSTALLATION ASSEMBLY OF ROLLING BRUSH

(71) Applicant: Dreame Innovation Technology (Suzhou) Co., Ltd., Suzhou (CN)

(72) Inventors: Xu Xu, Suzhou (CN); Congchao Xu, Suzhou (CN); Kai Liu, Suzhou (CN)

(73) Assignee: Dreame Innovation Technology (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 18/670,468

(22) Filed: May 21, 2024

(30) Foreign Application Priority Data

Mar. 15, 2024 (CN) ..... 202420513576.7

(51) Int. Cl.

| | |
|---|---|
| ***A47L 11/19*** | (2006.01) |
| ***A47L 9/04*** | (2006.01) |
| ***A47L 9/28*** | (2006.01) |
| *A47L 11/18* | (2006.01) |
| *A47L 11/40* | (2006.01) |

(52) U.S. Cl.
CPC ..... *A47L 11/19* (2013.01); *A47L 9/0477* (2013.01); *A47L 9/2831* (2013.01); *A47L 9/2842* (2013.01); *A47L 11/185* (2013.01); *A47L 11/4011* (2013.01)

(58) Field of Classification Search
CPC ..... A47L 11/19; A47L 9/0477; A47L 11/185; A47L 9/2831; A47L 9/2842; A47L 11/4011
See application file for complete search history.

(56) References Cited

U.S. PATENT DOCUMENTS

| | | | | |
|---|---|---|---|---|
| 10,667,662 | B2 * | 6/2020 | Carswell | A47L 9/06 |
| 2022/0087489 | A1 * | 3/2022 | Kwon | A47L 9/0477 |

FOREIGN PATENT DOCUMENTS

| | | | | |
|---|---|---|---|---|
| DE | 10201202832 | A1 * | 4/2013 | A47L 9/0477 |
| WO | WO2021112354 | * | 6/2021 | A46B 13/001 |

* cited by examiner

*Primary Examiner* — David Redding

(57) ABSTRACT

The present application provides a cleaning device, a floor brush assembly and an installation assembly of rolling brush. The cleaning device includes a rolling brush assembly and a connection assembly, the rolling brush assembly and the connection assembly are connected by an installation assembly, and the installation assembly includes a control rod; when the control rod moves, the rolling brush assembly and the connection assembly can be disengaged, so that when replacing the rolling brush assembly, the connection assembly connected with the rolling brush assembly is not required to be replaced, and the rolling brush assembly can be installed or disassembled more conveniently through the installation assembly.

18 Claims, 9 Drawing Sheets

CLEANING DEVICE, FLOOR BRUSH ASSEMBLY AND INSTALLATION ASSEMBLY OF ROLLING BRUSH

CROSS-REFERENCE TO RELATED APPLICATION

This application claims priority to Chinese Patent Application No. 202420513576.7, filed on Mar. 15, 2024, which is hereby incorporated by reference in its entirety.

TECHNICAL FIELD

The present application relates to the field of cleaning device, in particular to a cleaning device, a floor brush assembly and an installation assembly of rolling brush.

BACKGROUND

With the development of the field of cleaning device, more and more families begin to use cleaning device for home cleaning, among which, the most prominent one is the floor washing machine, which is popular in the current market. The floor washing machine often has a good cleaning ability when dealing with family's cleaning demands, mainly due to a rotary cleaning of a bottom rolling brush thereof and a suction of a large suction force cooperated therewith.

With the floor washing machine being widely used in our daily life, users find that for the floor washing machine, after being used for a long period, the rolling brush thereof will wear out, resulting in a decreased cleaning ability. Therefore, it is necessary to replace the rolling brush regularly. However, at present, the replacement of rolling brush often requires the replacement of the additional installation accessories connected with the floor brush.

Based on this, from the user's perspective, an increased replacement cost is inevitable, while from the manufacturer's perspective, a manufacturing cost of the above-mentioned vulnerable part is relatively high, and a relative profit will also suffer a certain loss when its sales price remains basically unchanged.

SUMMARY

In order to solve the above-mentioned problem that installation accessories need to be replaced together when replacing the rolling brush, the present application provides a solution which is convenient for the disassembly and installation of the rolling brush. This solution can replace the rolling brush only during the replacement, without replacing the installation accessories connected with the rolling brush. The specific solution is as follows.

The present application provides a cleaning device, which including a device body and a floor brush assembly connected with the device body; the floor brush assembly includes: a base; a rolling brush assembly, the rolling brush assembly includes a rolling brush body and a support portion provided on a side of the rolling brush body, and the support portion is connected with the base through a connection assembly.

The connection assembly includes a connection body, one end of the connection body is connected with the base, and the other end of the connection body is connected with the support portion through an installation assembly, and the support portion is rotatably provided relative to the installation assembly.

The installation assembly includes a control rod, and the support portion is configured to be separated from the installation assembly when the control rod moves along its axial direction.

In the daily use process, the replacement of a rolling brush assembly needs to replace all accessories connected with the rolling brush assembly, for example, a connection assembly connected with the rolling brush assembly needs to be replaced together. In this solution, an installation assembly is provided, so that the rolling brush assembly and the connection assembly can be separated through the installation assembly.

In other words, according to the solution of the present application, the rolling brush assembly can be disassembled solely, while the installation assembly and the connection assembly are retained, and the user only needs to connect the replaced rolling brush assembly with the installation assembly when replacing, without replacing installation accessories connected with the rolling brush assembly.

From the perspective of manufacturing, the cost can be greatly reduced. For example, when the above-mentioned consumable parts need to produce 2,000,000 pieces every year and there are 10,000 users who purchase cleaning device, the above-mentioned structure can save the cost of 1,900,000 pieces of connection assemblies, which is very profitable for manufacturers.

At the same time, from the perspective for user experience, driving the control rod can realize the disengagement between the control rod and the support portion without using a large number of buckles, which is more automatic. It is conceivable that if the rolling brush assembly and the connection assembly are disassembled by means of the prior art, most of which are disassembled by means of buckles, screwing, forced plugging and so on, the above modes are more inconvenient than disassembling the rolling brush assembly, requiring users to spend more time or effort to disassemble, and the user experience is poor.

In an implementation, the control rod moves along its axial direction is configured such that the control rod moves towards the support portion.

The above solution describes that the user can disengage the connection between the installation assembly and the support portion by a pressing mode, which is more convenient for the user.

In an implementation, the control rod moves along its axial direction is configured such that the control rod moves away from the support portion.

The connection between the installation assembly and the support portion can be disengaged by pressing as introduced above, and correspondingly, the connection between the installation assembly and the support portion can also be disengaged by pulling. These two modes are relatively convenient as compared with other modes.

In an implementation, the installation assembly includes a fixing element, the support portion is sleeved on an outer side of the control rod, the fixing element is provided between the support portion and the control rod, and the fixing element is disengaged from the support portion when the control rod displaces towards the support portion.

In the above solution, a fixing element is introduced, and when the user implements a control by pressing the control rod, the above fixing element can be disengaged from the support portion, so that the rolling brush assembly can be replaced.

In an implementation, the support portion is connected with the control rod, and when the control rod displaces towards the support portion, an end of the control rod connected with the support portion contracts inward and deforms, so as to realize its disengagement from the support portion.

The above describes another way for disengagement, that is, when the user does not need to replace rolling brush assembly, the control rod can abut against the support portion, so as to realize the connection between the control rod and the support portion.

When the user needs to replace rolling brush assembly, the control rod can be made to contract inward by pressing, so that there is a gap between the control rod and the support portion, that is, the rolling brush assembly can be disengaged, and the corresponding replacement can be carried out.

In an implementation, the control rod is provided with a position limiting portion, the position limiting portion is in contact with the fixing element, and when the control rod displaces towards the support portion, the position limiting portion is displaced and guides the fixing element to be disengaged from the support portion.

In this embodiment, the control rod is provided with a position limiting portion. When the user has no intention to replace it, the position limiting portion abuts against the fixing element, and the fixing element abuts against the support portion, so as to realize the connection between the control rod and the support portion. When the user needs to replace it, the position limiting portion of the control rod can be displaced by pressing the control rod, and at this time, the fixing element can be displaced correspondingly. The displacement of the fixing element is affected by the displacement of the position limiting portion, and the fixing element moves towards the control rod, thus generating a distance between the fixing element and the support portion, that is, the fixing element and the support portion are disengaged, and at this time, the user can carry out the displacement.

In an implementation, the position limiting portion includes a position limiting groove, and an end of the position limiting groove is provided with a first slope portion; when the control rod does not move, the first slope portion contacts and presses the fixing element tightly to realize a connection between the fixing element and the support portion; when the control rod displaces towards the support portion, the first slope portion is displaced and the fixing element moves towards inside of the position limiting groove, so as to realize disengagement from the support portion.

In this solution, a mode that the position limiting portion is a position limiting groove is provided, and at the same time, one end of the position limiting groove is provided with a first slope portion. When the user has no desire to replace, that is, when the control rod does not displace, the first slope portion abuts against the fixing element, so that the fixing element is connected with the support portion.

When the user needs to replace it, the control rod is pressed, and the first slope portion is displaced correspondingly, which leads to an abutting position disappearing and an abutting force for the fixing element losing, so that the fixing element will move towards the position limiting groove, and the user can carry out replacement accordingly.

Meanwhile, it needs to be understood that the above solution describes that the slope portion is caused to move by pressing the control rod, so that the fixing element moves towards the position limiting groove, thereby causing the disengagement between the support portion and the fixing element. In fact, the above function can also be realized by means of pulling, that is, the control rod is displaced by pulling, so that the fixing element moves, and then the disengagement between the fixing element and the support portion is realized.

In an implementation, the first slope portion is configured to be provided on a side of the position limiting groove far away from the connection body.

In this solution, the first slope portion is provided on a side of the position limiting groove away from the connection body, so that its position can match the pressing mode.

Imagine that the control rod, as it is pressed, moves towards the support portion, and the first slope portion gradually moves away from a contact position of the fixing element, which brings out that the position limiting groove contacts with the fixing element gradually, so that the fixing element will displace towards the position limiting groove, thus disengaging from the support portion, that is, the replacement of the rolling brush assembly can be realized.

Of course, it should be understood that it can also be adapted to the pulling mode, that is, the first slope portion is provided on a side of the position limiting groove close to the connection body. In a pulling process, the first slope portion will also gradually move away from the fixing element, thus guiding the fixing element to move towards the position limiting groove, and then replacement is realized.

In an implementation, the position limiting portion includes a position limiting boss, and an end of the position limiting boss is provided with a second slope portion; when the control rod does not move, the position limiting boss abuts against and presses the fixing element tightly to realize a connection between the fixing element and the support portion, and when the control rod displaces towards the support portion, the fixing element is disengaged from the support portion along the second slope portion.

This solution also provides another way of position limiting portion, that is, when the position limiting portion is configured as a position limiting boss, in a normal use process, the position limiting boss abuts against the fixing element, thus realizing a connection with the support portion.

When the rolling brush assembly needs to be replaced, the position limiting boss is disengaged from the fixing element by moving the control rod, so that the rolling brush assembly can also be replaced.

In an implementation, the second slope portion is provided on a side of the position limiting boss close to the connection body.

Similarly, in this solution, the second slope portion is provided on a side of the position limiting boss close to the connection body. Imagine that when the control rod is pressed, that is, when the control rod moves close to the support portion, the position limiting boss is gradually disengaged from the fixing element, followed by the second slope portion, which can guide the fixing element to move towards a lower position, so as to be disengaged from the support portion. Here, a higher position refers to a position of the position limiting boss, and the lower position refers to other positions of an outer side the control rod except the position where the position limiting boss protrudes.

In an implementation, the installation assembly includes a fixing element, the fixing element is connected with the support portion, and when the control rod moves along its axial direction and contracts inward, the fixing element is disengaged from the support portion.

The present application also provides a connection solution here, which also includes a fixing element. The connection mode of the fixing element here is to realize the disengagement from the support portion through the contraction of the control rod, and the rolling brush assembly can also be replaced by pressing.

In an implementation, the fixing element is configured as a buckle provided on an outer side of the control rod, and the support portion is provided with a buckle groove engaged with the buckle, and when the control rod contracts, the buckle is disengaged from the buckle groove.

In this solution, the fixing element is directly configured as a part of the control rod, that is, the buckle here, and the support portion is provided with a corresponding buckle groove. When the control rod contracts and deforms, the buckle and the buckle groove can be forcibly disengaged, so that the replacement of the rolling brush assembly can also be realized.

In an implementation, the installation assembly includes a support tube, the control rod is inserted into the support tube, and an end close to the support portion is provided with at least one notch radially penetrated through the control rod.

The outer side of the control rod is also provided with a first protrusion and a second protrusion is provided on an inner side of the support tube; when the control rod is configured to move towards the support portion, the first protrusion contacts with the second protrusion, so as to force an end of the control rod facing the notch to contract towards the notch.

The fixing element passes through the support tube and is provided between the control rod and the support portion, and when the control rod contracts, the fixing element moves away from the support portion, so as to realize the disengagement from the support portion.

The above solution provides a solution for setting a support tube. The control rod is inserted into the support tube, and meanwhile one end of the control rod is provided with a through notch, the setting of the notch makes the control rod have a deformation space. At the same time, an inner side of the support tube and an outer side of the control rod are respectively provided with a second protrusion and a first protrusion, so that the second protrusion and the first protrusion can contact with each other when the control rod moves. It is conceivable that the control rod will continue to move after the second protrusion and the first protrusion contact, and the second protrusion of the support tube will inevitably force the control rod to move towards the notch, thus realizing the contraction and deformation of the control rod.

At the same time, the fixing element passes through the support tube to connect the control rod, the support tube and the support portion respectively, so as to realize that the control rod is connected with the support portion through the fixing element. In other words, the control rod has a base ability to directly control the fixing element and the support portion, and when the control rod contracts, the fixing element moves to realize the disengagement from the support portion.

Of course, it is conceivable that at least the part of the control rod in contact with the fixing element can also be made of elastic material, which can contract and deform so as to realize the disengagement of the above fixing element from the support tube.

In an implementation, a bearing is provided in the connection body, and the installation assembly includes a support tube, one end of the support tube is inserted into the bearing and the other end of the support tube is inserted into the support portion.

The control rod is inserted into the support tube and is movable relative to the support tube, the fixing element passes through the support tube and is provided between the control rod and the support portion to form a connection of the control rod, the support tube and the support portion.

In the above solution, it described a way that the support tube can drive the support portion to rotate, that is, a way to drive the rolling brush assembly to rotate, and at the same time, the fixing element and the control rod can be combined to realize the disengagement and connection between the fixing element and the support portion.

In an implementation, the fixing element is configured as a spherical structure.

The above solution introduces that the fixing element can be a spherical structure, that is to say, the fixing element can be a roll ball-like structure, which will be smoother when moving because it will not be limited by edges and corners.

In an implementation, the control rod is provided with a plurality of the fixing elements around its circumferential direction, and when the control rod moves towards the support portion, the fixing elements are disengaged from the support portion.

The above also provides a multi-fixing element solution. When only one fixing element is provided in the circumferential direction of the control rod, it may be easy to shaking. Therefore, a plurality of fixing elements can be provided around its circumferential direction to enhance its stability.

In an implementation, a third protrusion is provided on an outer side of the control rod, and a fourth protrusion is provided on an inner side of the support tube; a spring is sleeved on an outer side of the control rod, one end of the spring abuts against the third protrusion, and the other end of the spring abuts against the fourth protrusion, so that the control rod can be reset by the spring after moving relative to the support tube.

In the above solution, a solution of adding a spring to the control rod is provided. On the basis of setting the third protrusion and the fourth protrusion, when the control rod moves, and after the movement is over, it can be correspondingly reset by the spring, which makes its control more convenient.

In an implementation, the support tube is provided with an accommodation port at least equal to a diameter of the fixing element, and a snap ring is also provided on an outer side of the support tube, and the snap ring is embedded between the support tube and the fixing element, so as to prevent the fixing element from coming out towards the outer side of the support tube.

The solution further provides a solution for connecting the support tube with the fixing element and a position limiting structure for the fixing element. It should be understood that controlling the movement of the fixing element by the movement of the control rod to disengage the fixing element from the support portion, which requires the movement of the fixing element, but it is possible that when the control rod moves too fast, the fixing element may come out of the outer side of the support tube. Therefore, the present application provides a solution for limiting the fixing element by using a snap ring, which can prevent the fixing element from coming out towards the outer side of the support tube.

In an implementation, the support tube is configured to include a fixing section and a connection section connected with the fixing section, the fixing section is configured as a cylindrical structure and passes through the bearing and is fixed with the bearing, and the connection section is configured as a square structure, and the support portion is configured with a square notch, and the connection section is detachably inserted into the square notch and connected with the support portion through the fixing element.

The above solution introduces that the support tube can be divided into two sections, that is, a square section connected with the support portion and a cylindrical section connected with a bearing. The arrangement of the square section can prevent the support portion from disengaging when rotating. Imagine that when a circle is in contact and fitted with another circle, if they are not completely fixed, they will easily disengage with the increase of the rotation speed, but this problem can be avoided by the square structure, and the rotation can be limited by four sharp corners.

In an implementation, the support portion is configured with a bayonet for accommodating a part of the fixing element, so that when the fixing element is connected with the support portion, the part of the fixing element is clamped in the bayonet, so as to prevent the disengagement from the support portion.

The above solution introduces a better connection mode between the support portion and the fixing element, that is, a bayonet is provided on the inner side of the support portion, which can accommodate a part of the fixing element, that is, when the fixing element is abutted by the control rod, one part of the fixing element is trapped in the control rod, and the other part is trapped in the bayonet on the inner side of the support portion, so that the three parts can be connected more tightly.

In an implementation, a fixing ring is provided in the support portion, the control rod penetrates through and is provided in the fixing ring, the fixing ring is configured to be made of a metal material, and the fixing ring is configured with a bayonet for accommodating a part of the fixing element, so that when the fixing element is connected with the support portion, the part of the fixing element is clamped in the bayonet, so as to prevent the disengagement from the support portion.

The above solution further introduces a better connection mode between the support portion and the fixing element, that is, by setting the fixing ring, the fixing ring can be made of metal material, so the rigidity of a joint is stronger.

It should be understood that the support portion in this solution is a part of the rolling brush assembly, that is to say, it also belongs to a vulnerable part, so by setting a small part of it to be made of metal material, it can not only increase the connection strength, but also avoid a solution that the whole support portion is made of metal material in pursuit of rigidity. In other words, the setting of the fixing ring not only ensures the connection strength, but also saves some costs.

In an implementation, the bayonet is configured as an arc-shaped notch arranged on one side or both sides of the fixing ring.

The solution of a bayonet has been introduced above, and a solution where the bayonet mentioned above can be set as an arc-shaped notch on one side or both sides of the fixing ring is further provided here. The arc-shaped notch can be adapted to the spherical fixing element, and it is set on both sides of the fixing ring, so the processing difficulty is significantly reduced, compared with being set on an inner side of the fixing ring.

In an implementation, an end of the control rod extending out of the support tube and close to the support portion is provided with a position limiting ring, and the position limiting ring is clamped on the control rod and protrudes from a connection port of the control rod and the support tube, so as to limit an extension length of the control rod.

Based on the above technical problems, the present application also provides a floor brush assembly, and the specific solution is as follows.

A floor brush assembly, including: a base; a rolling brush assembly, the rolling brush assembly includes a rolling brush body and a support portion provided on a side of the rolling brush body, and the support portion is connected with the base through a connection assembly; the connection assembly includes a connection body, one end of the connection body is connected with the base, and the other end of the connection body is connected with the support portion through an installation assembly, and the support portion is rotatably provided relative to the installation assembly; the installation assembly includes a control rod, and the support portion is configured to be separated from the installation assembly when the control rod moves along its axial direction.

Accordingly, an installation assembly of rolling brush, applied to an installation of a rolling brush of a cleaning device is also provided, a support portion is installed on a side of the rolling brush, where the support portion is connected with the installation assembly, and the installation assembly includes a control rod, and the support portion is configured to be separated from the installation assembly when the control rod moves along its axial direction.

It should be understood that the technical effects described above are not only all the technical effects of the present application, but other effects will be further elaborated in the following.

BRIEF DESCRIPTION OF DRAWINGS

In order to explain the technical solutions in the embodiments of the present application or the prior art more clearly, the drawings needed for the description of the embodiments or the prior art will be briefly introduced below. Obviously, the drawings in the following description are some embodiments of the present application. For those skilled in the art, other drawings can be obtained according to these drawings without paying creative labor.

Figure 1:
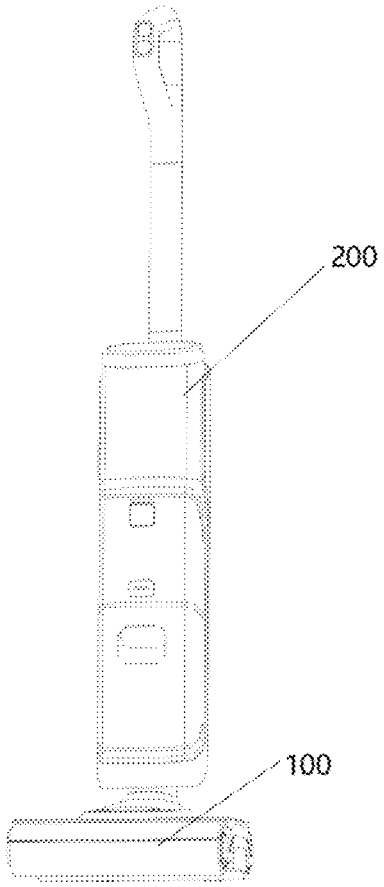
FIG. 1 is a schematic diagram of the cleaning device of the present application.

DESCRIPTION OF REFERENCE NUMBERS:

100: Floor brush assembly; 200: Device body;

1: Rolling brush assembly; 2: Connection assembly; 3: Base;

101: Support portion; 102: Rolling brush body; 103: Rolling brush cavity;

201: Installation assembly; 202: Connection body;

1011: Bayonet; 1012: Fixing ring;

10121: Main body; 10122: Arc-shaped notch: 10123: Clamping cavity;

2011: Control rod; 2012: Spring; 2013: Accommodation port; 2014: Support tube; 2015: Bearing;

2016: Fixing element; 2017: Position limiting portion; 2018: Snap ring; 2019: Position limiting ring; 2020: Installation boss;

20111: Third protrusion; 20112: First protrusion;

20141: Fixing section; 20142: Connection section; 20143: Fourth protrusion; 20144: Second protrusion;

20171: First slope portion; 20172: Position limiting groove; 20173: Position limiting boss; 20174: Second slope portion.

DESCRIPTION OF EMBODIMENTS

The following explains the implementations of the application through specific examples, and those skilled in the art can easily understand other advantages and effects of the present application from the contents disclosed in this specification. The present application can also be implemented or applied through different specific implementations, and the details in this specification can be modified or changed based on different perspectives and applications without departing from the spirit of the present application.

It should be noted that the drawings provided in the present embodiments only illustrate the basic concept of the present application in a schematic way. The drawings only show the components related to the present application, and are not drawn according to the number, shape and size of the components in actual implementation. In actual implementation, the type, quantity and proportion of each component can be changed randomly, and the layout of the components may be more complicated.

At present, more and more users begin to use cleaning device for home cleaning, especially the popular floor washing machine. For example, the floor washing machine has a device body and a floor brush assembly connected with the device body. When cleaning, the user only needs to hold and push a handle provided on the device body. Generally, the floor washing machine also includes a clean water tank and a sewage tank. In a cleaning process, a liquid separator in the floor brush assembly will guide the water flow from the clean water tank to spray water to clean a rolling brush body in the floor brush assembly, so that the rolling brush body can clean a surface to be cleaned, and the surface to be cleaned will be wet by the rolling brush body, as so to achieve a better stains cleaning.

During the cleaning process of the rolling brush, it will suck the dirt into the sewage tank through a rotation and a suction of the device body, so it can be seen that the rolling brush body is actually a very important cleaning component in the floor washing machine, and it can clean the surface to be cleaned through high-speed rotation. It is conceivable that after a long period of cleaning, the rolling brush will be greatly worn, and the worn rolling brush will affect the subsequent cleaning effect.

Therefore, the rolling brush body needs to be replaced in time after being used for a period of time, so in fact, the rolling brush body is already a consumable, but the replacement of the rolling brush body now is more than just a replacement of the rolling brush body itself, the connection assembly connected with the base is need to be replaced together.

In other words, in the prior art, there is no device that the rolling brush assembly and the connection assembly can be installed or disassembled in a portable way. The rolling brush assembly is connected with the connection assembly non-detachably, so they need to be replaced together when replacing. It can be imagined that the cost waste caused by this is very high for both users and manufacturers.

In view of the above problems, the present application provides a solution that the rolling brush assembly and the connection assembly can be installed or disassembled in a portable way, and the installed rolling brush assembly will not be affected during use. The specific solution is as follows.

Referring to FIG. 1 to FIG. 4, FIG. 1 provides a cleaning device, which includes a device body 200 and a floor brush assembly 100 connected with the device body 200, and with a cooperation of the device body 200 and the floor brush assembly 100, the surface to be cleaned can be cleaned.

Figure 2:
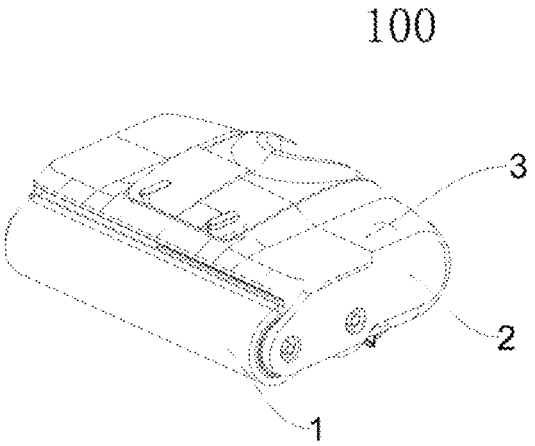
FIG. 2 is a schematic diagram of the floor brush assembly of the present application.

FIG. 2 shows a floor brush assembly 100, which includes a rolling brush assembly 1, a connection assembly 2 and a base 3. The rolling brush assembly 1 is connected with the base 3 through the connection assembly 2. In the prior art, it is necessary to replace the rolling brush assembly 1 together with the connection assembly 2 when replacing the rolling brush assembly 1.

However, in the solution of the present application, the connection assembly 2 and the rolling brush assembly 1 are connected through an installation assembly 201, the installation assembly 201 includes a control rod 2011. When the control rod 2011 is configured to move along its axis, the rolling brush assembly 1 and the connection assembly 2 can be separated. In other words, in the solution of the present application, the rolling brush assembly 1 can be disassembled through the control rod 2011, and it should be understood that the rolling brush assembly 1 can also be installed through the installation assembly 201.

Figure 3:
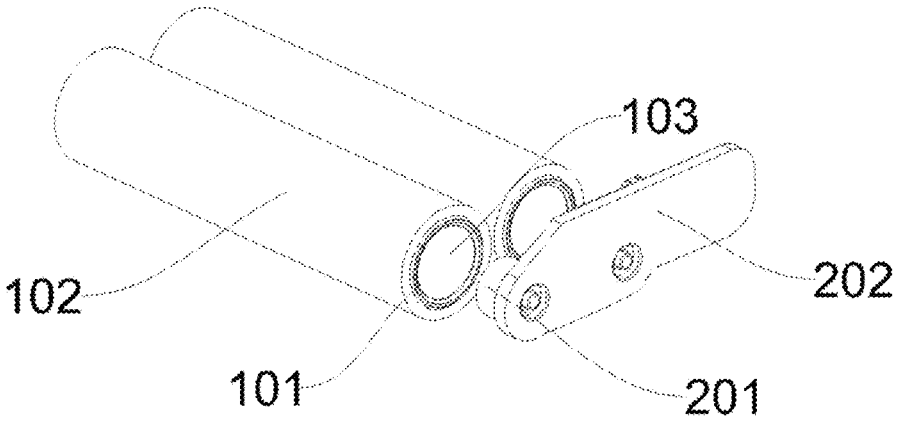
FIG. 3 is a schematic diagram of the disassembly and installation of the rolling brush assembly of the present application.

Referring to FIG. 3, it can be seen that FIG. 3 illustrates a state in which the rolling brush assembly 1 is disengaged from the connection assembly 2 through the installation assembly 201. At this time, when replacing the rolling brush assembly 1, it is no longer necessary to replace the rolling brush assembly 1 together with the connection assembly 2.

Figure 4:
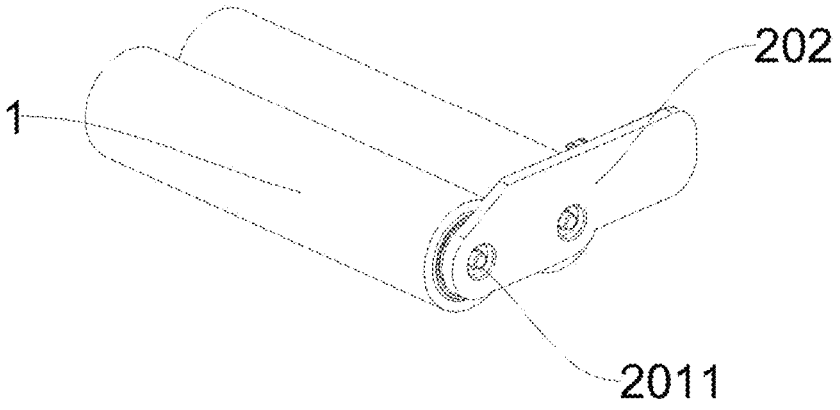
FIG. 4 is a schematic diagram of the rolling brush assembly of the present application after installation.

Referring to FIG. 4, it shows a state where the rolling brush assembly 1 is connected with the connection assembly 2. The rolling brush assembly 1 can be reliably installed through the installation assembly 201, and then it can be connected with the base 3 for cleaning.

Specifically, the rolling brush assembly 1 includes a rolling brush body 102 and a support portion 101 provided on a side of the rolling brush body 102. It should be understood that the support portion 101 here can be provided on an inner side of the rolling brush body 102 and located on a side of the rolling brush body 102, or can be directly connected with an outside of the rolling brush body 102. The rolling brush body 102 has a rolling brush cavity 103 (as see in FIG. 3).

The connection assembly 2 includes a connection body 202, an end of the connection body 202 is connected with the base 3 through the installation assembly 201, and the support portion 101 is rotatably connected with respect to the installation assembly 201, so that the rolling brush body 102 is rotatably connected with respect to the installation assembly 201 via the support portion 101.

The installation assembly 201 further includes the control rod 2011. In an implementation, the installation assembly 201 can be disconnected from the support portion 101 by moving the control rod 2011, so that the assembly or disassembly of the rolling brush assembly 1 can be controlled by manipulating the control rod 2011. It should be noted that the movement of the control rod 2011 here can be manually operated by the user, and of course it can also be automatically operated by automatic device, such as it can realize the movement of the control rod 2011 by cooperating with some driving structures. The driving structures here can be a gear and rack, a screw, a cam, an air tube and other structures.

In an implementation, the movement of the control rod 2011 can be configured to be movable along an axial direction of the control rod 2011. That is, from a perspective of a movement mode, the control rod 2011 can be controlled to move by a pressing mode or a pulling mode.

Specifically, the pressing mode is to drive the control rod 2011 to move towards the support portion 101, and the pulling mode is to drive the control rod 2011 to move away from the support portion 101 or to drive the control rod 2011 to move close to the connection body 202.

Figure 5:
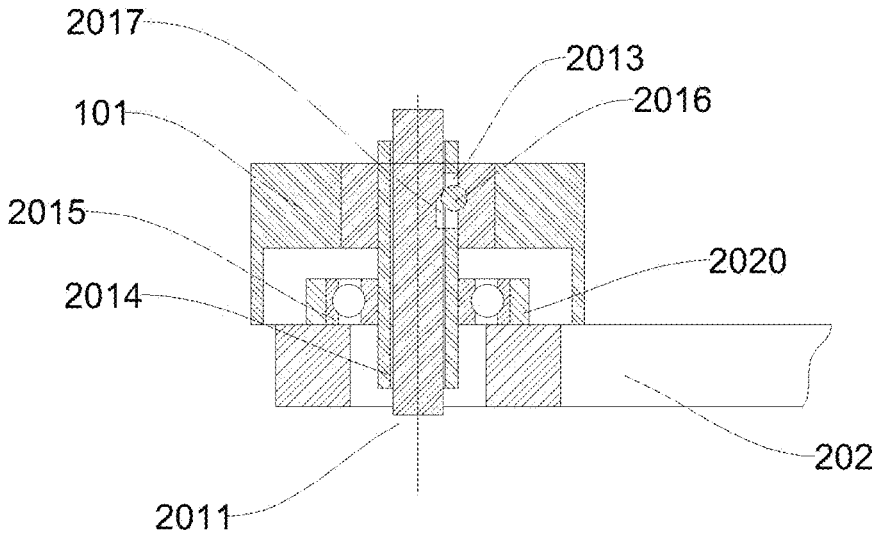
FIG. 5 is a sectional view of the installation assembly and the connection assembly of the present application.
Figure 6:
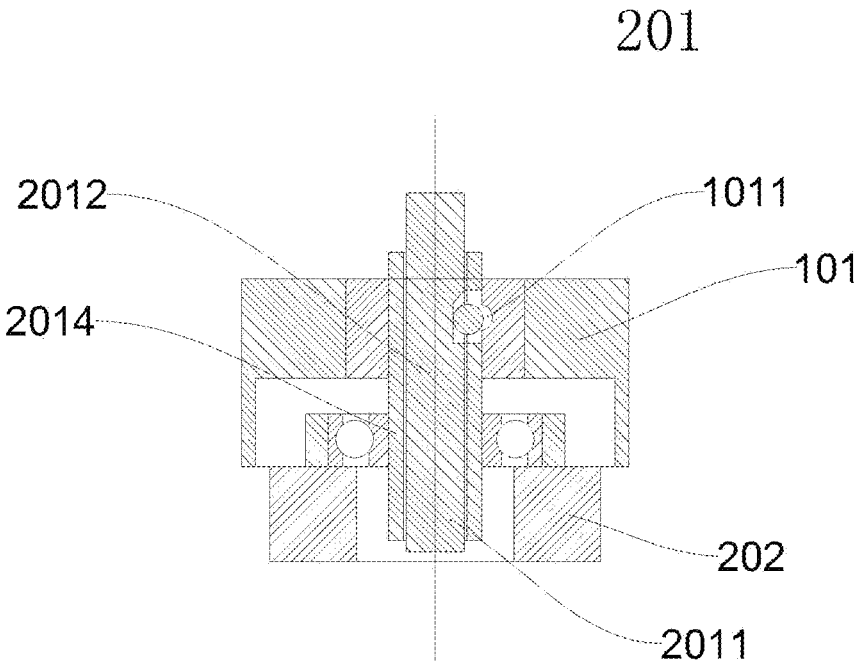
FIG. 6 is a sectional view of the installation assembly and the connection assembly of the present application.

Please continue to refer to FIG. 5 and FIG. 6, FIG. 5 shows an implementation of the installation assembly 201. Specifically, the installation assembly 201 includes a control rod 2011, and the support portion 101 is sleeved on the outer side of the control rod 2011, and a fixing element 2016 is provided between the support portion 101 and the control rod 2011, and the fixing element 2016 is connected with the support portion 101 and the control rod 2011; when the control rod 2011 is driven to move, the fixing element 2016 is disengaged from the support portion 101, so that the support portion 101 can be separated from the control rod 2011.

Here, the disengagement means that the fixing element 2016 also moves under the movement of the control rod 2011, so that it is no longer in contact with the support portion 101, so as to realize the disengagement between the fixing element 2016 and the support portion 101.

Of course, in another implementation, the control rod 2011 can be directly disengaged from the support portion 101 through its own deformation. Specifically, the support portion 101 is sleeved on the outer side of the control rod 2011, and when it needs to be disengaged, the control rod 2011 is driven to move, so that the control rod 2011 contracts and deforms, and the support portion 101 can be separated from the control rod 2011.

In normal use, the control rod 2011 abuts against the support portion 101, that is, the control rod 2011 is directly connected with the support portion 101. When it is necessary to be disengaged, the control rod 2011 is contracted to form a gap with the support portion 101, so that the rolling brush assembly 1 can be disengaged.

In an implementation, the control rod 2011 is also provided with a position limiting portion 2017, the position limiting portion 2017 abuts against the fixing element 2016 during normal use, and when the rolling brush assembly 1 needs to be disassembled, the position limiting portion 2017 is driven to move by driving the control rod 2011 to move, so that the fixing element 2016 loses its abutting force and is disengaged from the support portion 101. It should be understood that the movement of the control rod 2011 here includes both moving towards the support portion 101 and moving away from the support portion 101.

The above-mentioned position limiting by the position limiting portion 2017 enables the fixing element 2016 to be more reliably fixed and disengaged, thus making the usage experience better.

Figure 8:
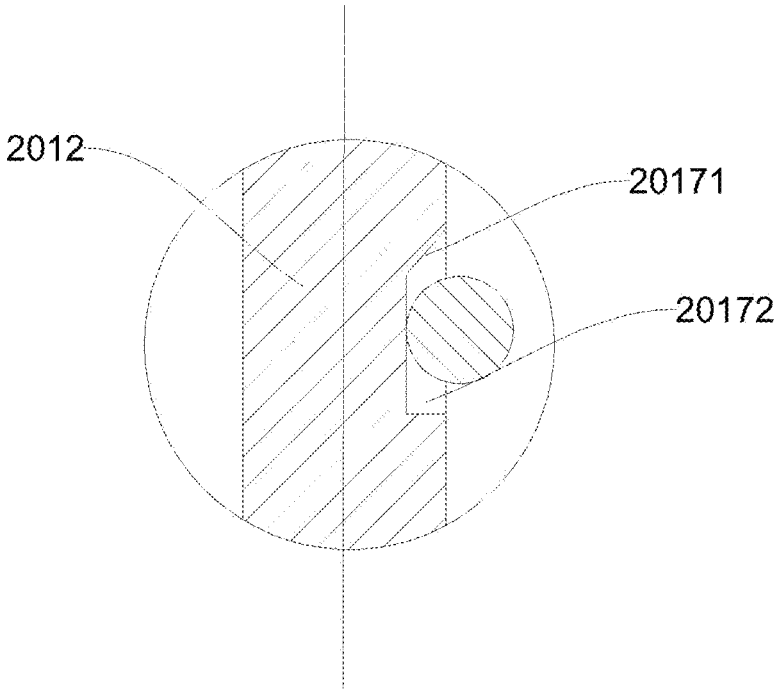
FIG. 8 is a schematic diagram of the connection between the position limiting portion and the fixing element of the present application.

Please continue to refer to FIG. 5, FIG. 6 and FIG. 8. In an implementation, the position limiting portion 2017 includes a position limiting groove 20172, and a side of the position limiting groove 20172 is provided with a first slope portion 20171. In normal use, the first slope portion 20171 abuts against the fixing element 2016, so that the support portion 101 is connected with the control rod 2011. When the control rod 2011 moves, the first slope portion 20171 moves and disengages from the fixing element 2016, so that the rolling brush assembly 1 can be replaced.

In an implementation, as shown in FIG. 5, the first slope portion 20171 is provided on a side of the position limiting groove 20172 away from the connection body 202. On this basis, by driving the control rod 2011 to move towards the support portion 101, the first slope portion 20171 can be disengaged from the fixing element 2016, so that the rolling brush assembly 1 can be replaced.

In another implementation, the first slope portion 20171 can of course also be provided on a side of the position limiting groove 20172 close to the connection body 202. By driving the control rod 2011 to move away from the support portion 101, the first slope portion 20171 can be disengaged from the fixing element 2016, and the rolling brush assembly 1 can be replaced in the same way.

In an implementation, the position limiting portion 2017 is configured as a boss structure, and the specific solution is as follows.

Figure 7:
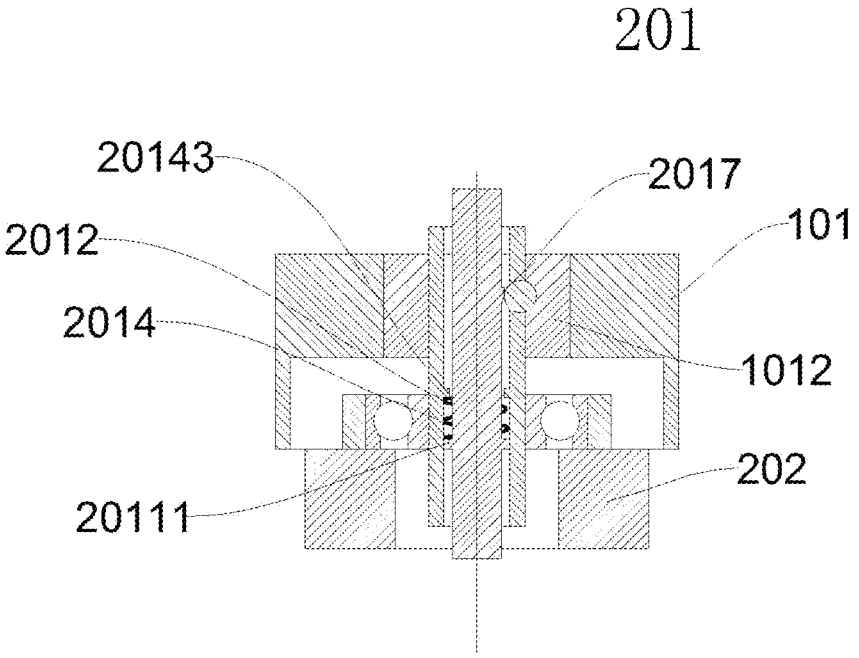
FIG. 7 is a sectional view of the installation assembly and the connection assembly of the present application.
Figure 9:
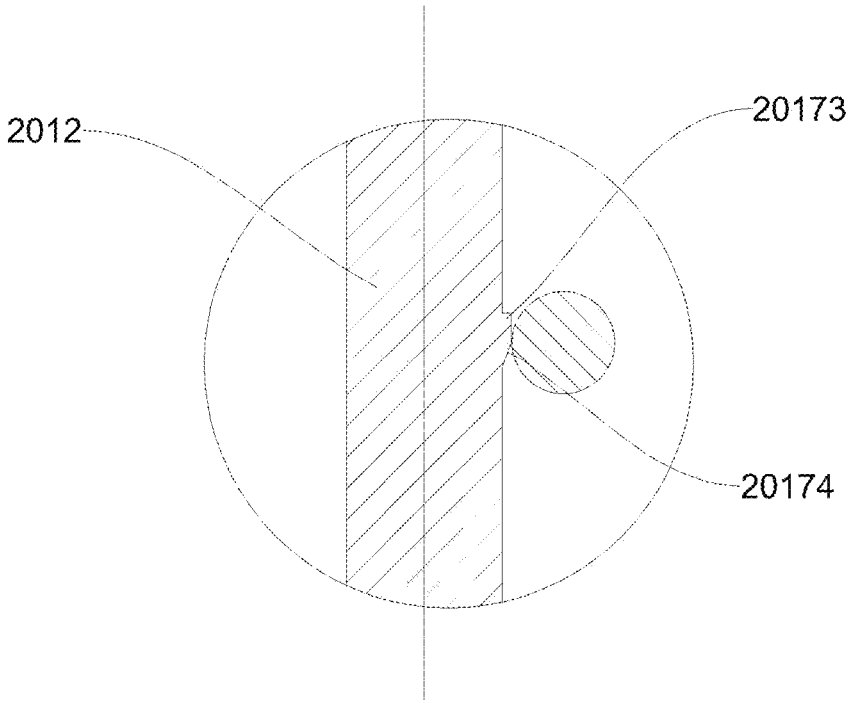
FIG. 9 is a schematic diagram of the connection between the position limiting portion and the fixing element of the present application.

Referring to FIG. 7 and FIG. 9, the position limiting portion 2017 provided on the control rod 2011 includes a position limiting boss 20173 and a second slope portion 20174 provided on a side of the position limiting boss 20173. Similarly, during normal use, the position limiting boss 20173 abuts against the fixing element 2016, thus providing an abutting force for the fixing element 2016 to ensure its connection with the support portion 101. After the control rod 2011 is driven by an external force to move, the position limiting boss 20173 gradually disengages from the fixing element 2016. The fixing element 2016 gradually loses connection with the support portion 101 along the second slope portion 20174, so that the fixing element 2016 is disengaged from the support portion 101.

It should be understood that two driving modes of the control rod 2011 are also included here, and the specific solution is as follows.

Please continue to refer to FIG. 7 and FIG. 9. The second slope portion 20174 is provided on a side of the position limiting boss 20173 close to the connection body 202. On this basis, when the control rod 2011 is driven to move towards the support portion 101, the position limiting boss 20173 will gradually disengage from the fixing element 2016, and the fixing element 2016 will also disengage from the support portion 101 along the second slope portion 20174.

In an implementation, the second slope portion 20174 is provided on a side of the position limiting boss 20173 away from the connection body 202. On this basis, when the control rod 2011 is driven to move away from the support portion 101, the position limiting boss 20173 and the fixing element 2016 will be disengaged, and the fixing element 2016 will also disengage from the support portion 101 along the second slope portion 20174.

It should be noted in particular that the slope portion here is not limited to an inclined plane, of course, it can also be a cambered surface or a surface with other shapes.

In an implementation, a deformation of the control rod 2011 itself and its cooperation with the fixing element 2016 can be used to realize the installation or disassembly, the specific solution is as follows.

Figure 10:
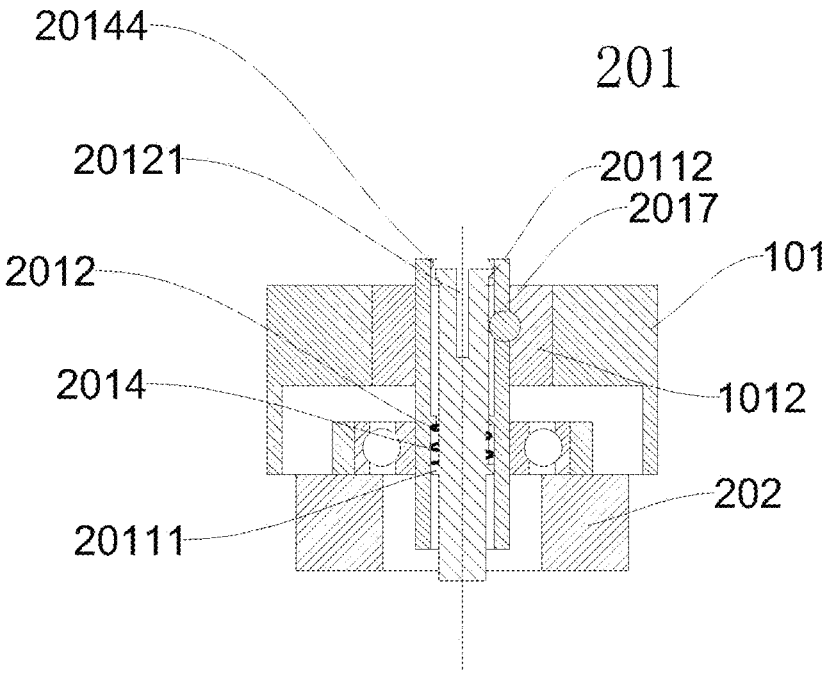
FIG. 10 is a sectional view of the installation assembly and the connection assembly of the present application.

With reference to FIG. 10, the solution that the control rod 2011 can be directly disengaged from the support portion 101 through its own deformation has been introduced above, while a solution introduced here is to use a deformation of the control rod 2011 itself and its cooperation with the fixing element 2016 to disengage from the support portion 101. The specific solution is as follows.

The fixing element 2016 is provided between the control rod 2011 and the support portion 101. When the control rod 2011 is contracted inward under an action of external force, the fixing element 2016 loses an abutting force of the control rod 2011 applied thereto, so that the fixing element 2016 is gradually disengaged from the support portion 101.

In an implementation, the fixing element 2016 is configured as a buckle (not shown in the figure) in the control rod 2011, and a buckle groove (not shown in the figure) matched with the buckle in the control rod 2011 is provided in the support portion 101.

In normal use, the buckle in the control rod 2011 is engaged with the buckle groove of the support portion 101, so as to realize a connection between the control rod 2011 and the support portion 101. When replacement is needed, the buckle is disengaged from the buckle groove by driving the control rod 2011 to achieve the purpose of replacing the rolling brush assembly 1.

Please continue to refer to FIG. 10, in another implementation, the installation assembly 201 includes a support tube 2014, a control rod 2011 is inserted into the support tube 2014, and a fixing element 2016 passes through the support tube 2014 and is respectively connected with the control rod 2011 and the support portion 101.

A first protrusion 20112 is provided on the outer side of the control rod 2011, and a second protrusion 20144 is provided on the inner side of the support tube 2014, and an end of the control rod 2011 is provided with at least one notch penetrated through the control rod 2011 radially. When the control rod 2011 moves, the first protrusion 20112 contacts the second protrusion 20144, because the control rod 2011 is provided with a notch penetrated through the control rod 2011. Therefore, the second protrusion 20144 forces the control rod 2011 to contract towards the notch, thereby achieving the purpose of contracting the control rod 2011, and thus realizing the disengagement of the fixing element 2016 from the support portion 101.

Of course, the above-mentioned contraction mode is only one solution provided in the present application, and other solutions can be adopted, for example, the control rod 2011 is at least partially set to an elastically contractible structure. Therefore, when the control rod 2011 moves the elastically contractible structure to the position of the fixing element 2016, through a contraction of the control rod 2011, the disengagement of the fixing element 2016 from the support portion 101 is realized.

Please refer to FIG. 5 to FIG. 7, the connection assembly 2 includes a connection body 202. One end of the connection body 202 is connected with the installation assembly 201, and the other end of the connection body 202 is connected with the base 3. In the present implementation, the connection body 202 can be a plate structure or a columnar structure, etc.

An end of the connection body 202 is provided with an installation boss 2020, a bearing 2015 is provided in the installation boss 2020, and the support tube 2014 is provided in the bearing 2015, so that the support tube 2014 can rotate.

The control rod 2011 is inserted into the support tube 2014 and connected with the support portion 101 through the fixing element 2016, so that the support portion 101 can rotate relative to the connection body 202, that is, the rotation of the rolling brush assembly 1 and the effective connection are ensured here, and at the same time, the rolling brush assembly 1 can be disassembled or assembled conveniently.

Please continue to refer to FIG. 5 to FIG. 7. In the multiple implementations provided above, the fixing element 2016 is configured as a ball structure. In other words, in one or more implementations, the fixing element 2016 is configured as a roll ball. The use of a ball structure can make it easier for the fixing element 2016 to be disengaged from the support portion 101. Compared with a structure with sharp corners, the surface of the ball structure is smoother and less likely to be stuck.

Various solutions for disassembly or assembly by using the fixing element 2016 have been described above, and most of the above solutions are described by using a single fixing element 2016. However, in the solution of the present application, a solution for fixing by using a plurality of fixing elements 2016 is also provided. When a single fixing element 2016 is connected, it may be easy to an unstable condition such as shaking because there is only one angle or plane being subjected to a connection force.

In order to solve the above problem, the control rod 2011 can be provided with a plurality of fixing elements 2016 around its axial direction. Of course, the control method is similar to the above solutions, and the above control methods are also used for a disengagement control, that is, when the control rod 2011 is driven to move, for example, when the control rod 2011 is driven to move towards the support portion 101, the multiple fixing elements 2016 are disengaged from the support portion 101.

At the same time, in order to prevent the control rod 2011 from disengaged when moving, the present application also provides a solution that can limit a position of the control rod 2011, the specific solution is as follows.

Figure 11:
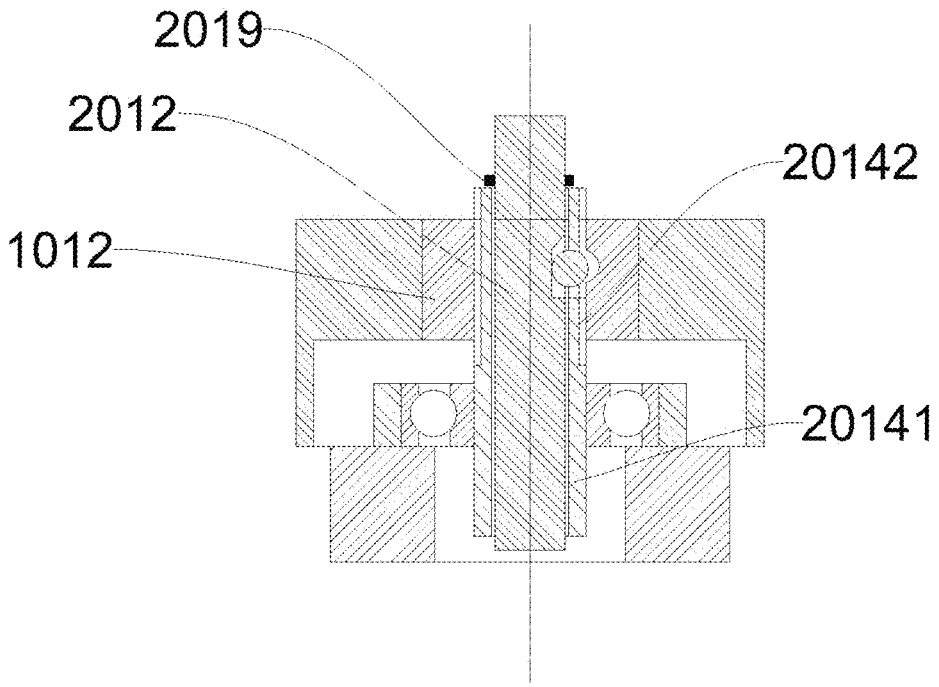
FIG. 11 is a sectional view of the installation assembly and the connection assembly of the present application.

Referring to FIG. 11, the control rod 2011 is inserted into and beyond the support tube 2014, and a position limiting ring 2019 is provided on a side beyond the support tube 2014 and close to the support portion 101, and the position limiting ring 2019 protrudes from a connection port between the control rod 2011 and the support tube 2014, so that the control rod 2011 can be prevented from being disengaged from the connection body 202 or can be limited at a proper position, thereby limiting an extending distance of the control rod 2011.

The solutions of moving and controlling the disengagement or assembly of the control rod 2011 are introduced in detail above. On this basis, the present application also provides a solution for reset. The specific solution is as follows.

Please refer to FIG. 7, a fourth protrusion 20143 is provided on an inner side of the support tube 2014, and a third protrusion 20111 is provided on an outer side of the control rod 2011. The control rod 2011 is sleeved with a spring 2012, one end of the spring 2012 abuts against the fourth protrusion 20143 and the other end of the spring 2012 abuts against the third protrusion 20111.

In this way, after the control rod 2011 is moved, it can be reset by the spring 2012. From the perspective of user experience, resetting by the spring 2012 will lead to a more convenient disassembly and assembly.

In another implementation, due to the fixing element 2016 penetrates through the support tube 2014, and based on the fixing element 2016 being a spherical structure, if the rolling brush assembly 1 is replaced, after the rolling brush assembly 1 is disassembled, the fixing element 2016 will easily come out towards an outer side of the support tube 2014 because an end of the fixing element 2016 loses its dependence. In order to solve the above problems, the present application also provides a solution that can effectively prevent the fixing element 2016 from coming out in the above-mentioned scenario.

Figure 12:
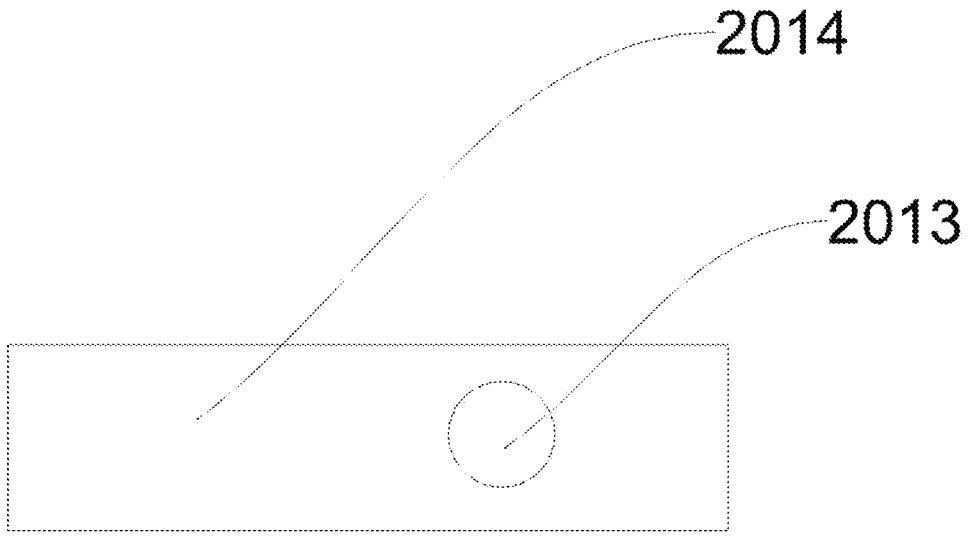
FIG. 12 is a schematic structural diagram of the support tube of the present application.
Figure 13:
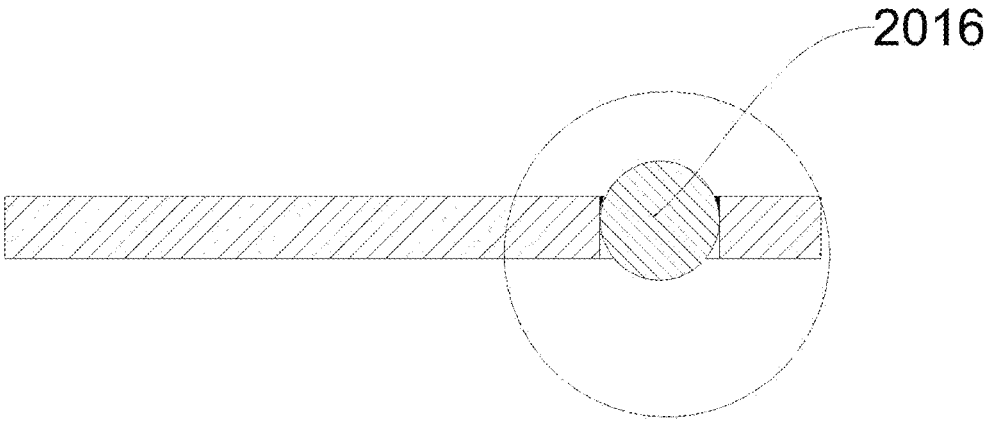
FIG. 13 is a schematic diagram of the connection between the support tube and the fixing element of the present application.
Figure 14:
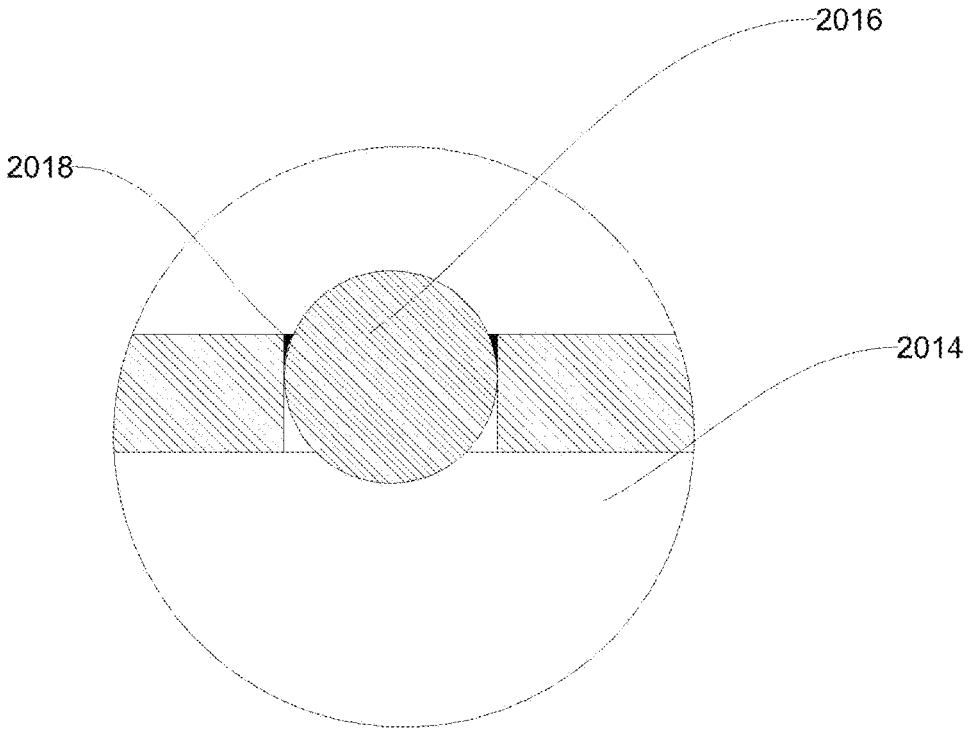
FIG. 14 is a schematic diagram of the connection between the support tube and the fixing element of the present application.

Please refer to FIG. 12-FIG. 14. An accommodation port 2013 is opened on the outer side of the support tube 2014, and a diameter of the accommodation port 2013 is at least equal to a diameter of the fixing element 2016, so that it can be ensure that the fixing element 2016 can penetrate through the support tube 2014. In order to prevent the fixing element 2016 from coming out, a snap ring 2018 is added, the snap ring 2018 includes an outer ring and an inner ring, the outer ring is adapted to a size of the opening of the accommodation port 2013, and the inner ring is adapted to a spherical surface of the fixing element 2016.

When installing the support tube 2014 and the fixing element 2016, the fixing element 2016 can be set in the accommodation port 2013 first, and then the snap ring 2018 can be clamped on the outer side of the fixing element 2016 and connected with the accommodation port 2013.

It should be understood that a connection mode here is not limited, and it can be connected by gluing or buckling, so that the stability of the fixing element 2016 when installing or disassembling the rolling brush assembly 1 can be further ensured through the arrangement of the snap ring 2018.

A connection relationship between the support portion 101 and the support tube 2014 has been described above, and the support portion 101 can be used to support and rotate through the support tube 2014. It should be understood that the rotation speed of the rolling brush of the cleaning device in a cleaning process is relatively high. Therefore, there may be a risk of disengagement or slippage between the support tube 2014 and the support portion 101. Based on this, the present application also provides a solution to solve the above problem, the specific solution is as follows.

Figure 17:
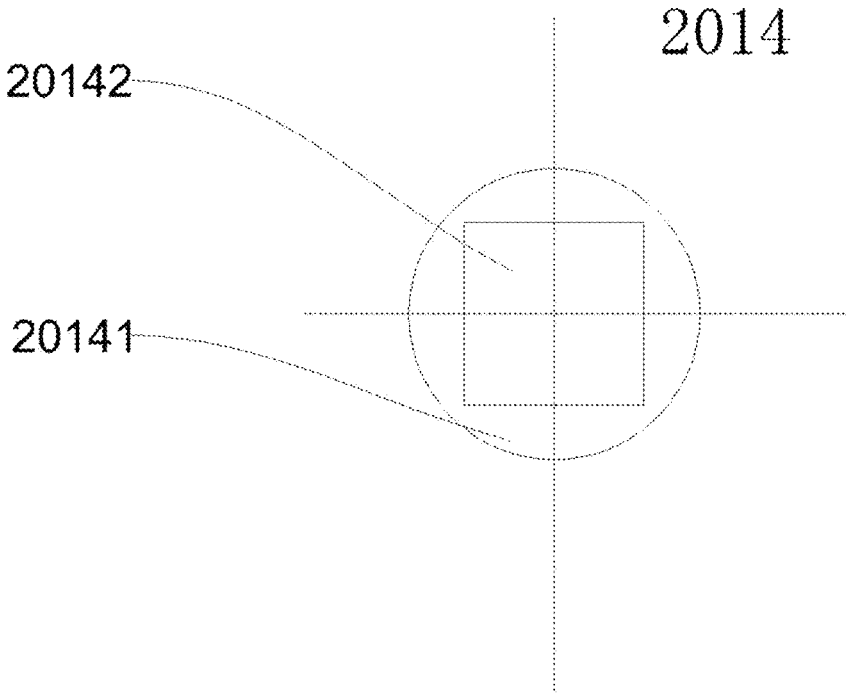
FIG. 17 is a schematic structural diagram of the support tube of the present application.

Please refer to FIG. 11 and FIG. 17, the support tube 2014 includes a fixing section 20141 and a connection section 20142. The fixing section 20141 is cylindrical structure and is sleeved on an inner circle of the bearing 2015. The connection section 20142 is set to a square structure, and an interior of the support portion 101 is provided with a square notch matched with the square structure, and the connection section 20142 is inserted into the square notch. Therefore, the rotary transmission between the support portion 101 and the support tube 2014 includes two ways. The first way is that a fixing element 2016 connects the support tube 2014 and the support portion 101, so that when the support tube 2014 rotates, it will naturally drive the support portion 101 to rotate; the second way is that the support tube 2014 and the support portion 101 are both in a square structure, due to the square structure, when the support tube 2014 rotates, it can drive the support portion 101 to rotate through the above four corners.

That is, the above-mentioned rotation is carried out by means of a cooperation of the two ways, thus making the transmission more stable.

It is described above that by a cooperation of the square structures, an enhanced stability can be achieved when rotating, but at the same time, the above solution will also bring a defect, that is, the cooperation of the square structures will aggravate the wear, especially the above-mentioned sharp corner structure. In order to solve the above problem, the present application also provides a solution that can alleviate the wear, the specific solution is as follows.

Figure 15:
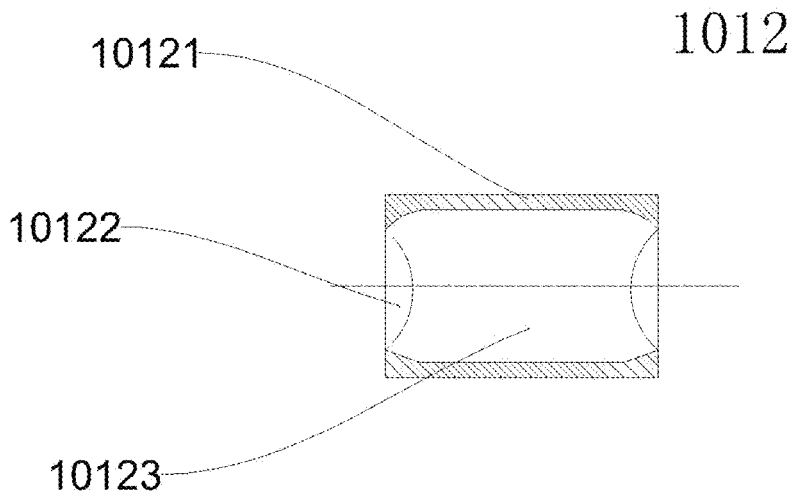
FIG. 15 is a schematic sectional view of the fixing ring structure of the present application.
Figure 16:
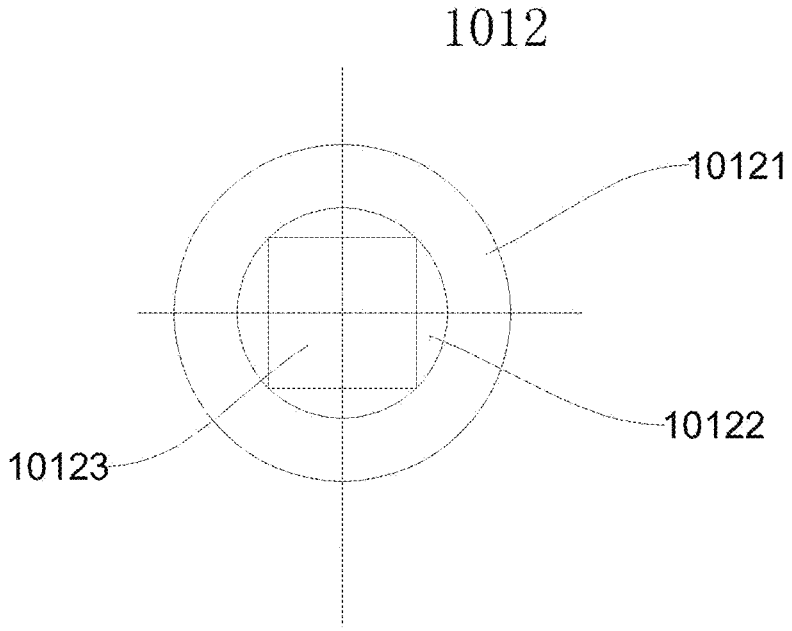
FIG. 16 is a schematic structural diagram of the fixing ring of the present application.

As shown in FIG. 11, FIG. 15 and FIG. 16, a fixing ring 1012 is provided in the support portion 101, the fixing ring 1012 is configured to be made of a metal material, and the control rod 2011 is provided in the fixing ring 1012, that is, the connection section 20142 is inserted into the fixing ring 1012.

In an implementation, the fixing ring 1012 is connected with the connection section 20142 through a square structure. Due to the fixing ring 1012 is made of metal material, its hardness is relatively higher, and its wear can be alleviated in a high-speed rotation, which means that the use of the fixing ring 1012 not only ensures the stability of transmission, but also solves the problem that the fixing ring 1012 is easy to wear.

The solution of connecting the control rod 2011 with the support portion 101 through the fixing element 2016 has been described in detail above. On this basis, the present application also provides a solution that can improve the stability of the fixing element 2016 and the support portion 101 after assembly, the specific solution is as follows.

The inner side of the support portion 101 is provided with a bayonet 1011 for accommodating a part of the fixing element 2016. When the fixing element 2016 is connected with the support portion 101, the part of the fixing element 2016 can be clamped in the bayonet 1011, so that a connection stability between the fixing element 2016 and the support portion 101 can be enhanced.

Further, the bayonet 1011 can be provided on one side or both sides of the support portion 101, which makes it easier to open the bayonet 1011.

Of course, in another implementation, the bayonet 1011 can also be provided on the fixing ring 1012, as shown in FIG. 15 and FIG. 16. The bayonet 1011 is an arc-shaped notch 10122 provided on one side or both sides of the fixing ring 1012, and the fixing ring 1012 includes a main body 10121, in which a clamping cavity 10123 is provided, and a support tube 2014 is clamped in the clamping cavity 10123. The arc-shaped notch 10122 is provided at one side or both sides of the clamping cavity 10123.

When the fixing element 2016 is in contact with the fixing ring 1012, the fixing element 2016 is clamped in the arc-shaped notch 10122, so as to realize a more stable connection.

The cleaning device that can realize a convenient disassembly and installation of the rolling brush assembly 1 is described above. On this basis, the present application also provides a floor brush assembly, which can also solve the above technical problems. The specific solution is as follows.

A floor brush assembly, including: a base 3 and a rolling brush assembly 1, where the rolling brush assembly 1 includes a rolling brush body 102 and a support portion 101 provided on a side of the rolling brush body 102, and the support portion 101 is connected with the base 3 through a connection assembly 2; the connection assembly 2 includes a connection body 202, one end of the connection body 202 is connected with the base 3, and the other end of the connection body 202 is connected with the support portion 101 through an installation assembly 201, and the support portion 101 is rotatably provided relative to the installation assembly 201; the installation assembly 201 includes a control rod 2011, and the support portion 101 is configured to be separated from the installation assembly 201 when the control rod 2011 moves along its axial direction.

It should be understood that this solution can also be combined with other further solutions about the support portion 101 and the control rod 2011, which will not be repeated thereto.

At the same time, the present application also provides an installation assembly of rolling brush, which is applied to an installation of a rolling brush of a cleaning device. A side of the rolling brush body 102 is installed with a support portion 101, the support portion 101 is connected with the installation assembly 201. The installation assembly 201 includes a control rod 2011, and the support portion 101 is configured to be separated from the installation assembly 201 when the control rod 2011 moves along its axial direction.

It should be understood that this solution can also be combined with other further solutions about the support portion 101 and the control rod 2011, which will not be repeated thereto.

Application scenario: after a cleaning device is used for a long time, the rolling brush assembly needs to be replaced. At this time, the rolling brush assembly 1 can be pulled out first, due to the connection assembly 2 is connected with the rolling brush assembly 1, they will be pulled out integrally. At this time, by pressing the control rod 2011, a fixing element 2016 inside the installation assembly 201 is disengaged from a support portion 101 on a side of the rolling brush body 102, so that the rolling brush assembly 1 can be pulled out. Meanwhile, during installation, the control rod 2011 can be pressed to connect the support portion 101 connected with the rolling brush body 102 with the installation assembly 201, so as to realize the assembly of the rolling brush assembly 1. Of course, it is also possible to connect the rolling brush assembly 1 with the connection assembly 2 by using a pressure of the support portion 101 on the fixing element 2016 without pressing the control rod 2011 during installation.

Finally, it should be explained that the above embodiments are only used to illustrate the technical solution of the present application, but not to limit it. Although the present application has been described in detail with reference to the foregoing embodiments, it should be understood by those skilled in the art that the technical solution described in the foregoing embodiments can still be modified, or part of or all of the technical features can be replaced by equivalents. However, these modifications or replacements do not make the essence of the corresponding technical solutions deviate from the scope of the technical solutions of various embodiments of the present application.

What is claimed is:

1. A cleaning device, comprising a device body and a floor brush assembly connected with the device body; the floor brush assembly comprises:

a base; and a rolling brush assembly, wherein the rolling brush assembly comprises a rolling brush body and a support portion provided on a side of the rolling brush body, and the support portion is connected with the base through a connection assembly;

wherein the connection assembly comprises a connection body, one end of the connection body is connected with the base, and the other end of the connection body is connected with the support portion through an installation assembly, and the support portion is rotatably provided relative to the installation assembly;

wherein the installation assembly comprises a control rod, and the support portion is configured to be separated from the installation assembly when the control rod moves along its axial direction towards the support portion;

wherein the installation assembly further comprises a fixing element; and wherein:

the support portion is sleeved on an outer side of the control rod, the fixing element is provided between the support portion and the control rod, and when the control rod displaces towards the support portion, the fixing element is disengaged from the support portion: or the support portion is connected with the control rod, the fixing element is connected with the support portion, and when the control rod displaces towards the support portion, an end of the control rod connected with the support portion contracts inward and deforms, so as to realize its disengagement from the support portion.

2. The cleaning device according to claim 1, wherein when the support portion is sleeved on the outer side of the control rod, the control rod is provided with a position limiting portion, the position limiting portion is in contact with the fixing element, and when the control rod displaces towards the support portion, the position limiting portion is displaced and guides the fixing element to be disengaged from the support portion.

3. The cleaning device according to claim 2, wherein the position limiting portion comprises a position limiting groove, and an end of the position limiting groove is provided with a first slope portion; when the control rod does not move, the first slope portion contacts and presses the fixing element tightly to realize a connection between the fixing element and the support portion; when the control rod displaces towards the support portion, the first slope portion is displaced and the fixing element moves towards inside of the position limiting groove, so as to realize disengagement from the support portion.

4. The cleaning device according to claim 3, wherein the first slope portion is configured to be provided on a side of the position limiting groove away from the connection body.

5. The cleaning device according to claim 2, wherein the position limiting portion comprises a position limiting boss, and an end of the position limiting boss is provided with a second slope portion; when the control rod does not move, the position limiting boss abuts against and presses the fixing element tightly to realize a connection between the fixing element and the support portion, and when the control rod displaces towards the support portion, the fixing element is disengaged from the support portion along the second slope portion.

6. The cleaning device according to claim 5, wherein the second slope portion is provided on a side of the position limiting boss close to the connection body.

7. The cleaning device according to claim 1, wherein when the support portion is connected with the control rod, and when the control rod moves along its axial direction and contracts inward, the fixing element is disengaged from the support portion.

8. The cleaning device according to claim 7, wherein the fixing element is configured as a buckle provided on an outer side of the control rod, and the support portion is provided with a buckle groove engaged with the buckle, and when the control rod contracts, the buckle is disengaged from the buckle groove.

9. The cleaning device according to claim 7, wherein the installation assembly comprises a support tube, the control rod is inserted into the support tube, and an end close to the support portion is provided with at least one notch radially penetrated through the control rod;

the outer side of the control rod is also provided with a first protrusion and a second protrusion is provided on an inner side of the support tube; when the control rod is configured to move towards the support portion, the first protrusion contacts with the second protrusion, so as to force the end of the control rod facing the notch to contract towards the notch;

the fixing element passes through the support tube and is provided between the control rod and the support portion, and when the control rod contracts, the fixing element moves away from the support portion, so as to realize disengagement from the support portion;

wherein the end of the control rod extending out of the support tube and close to the support portion is provided with a position limiting ring, and the position limiting ring is clamped on the control rod and protrudes from a connection port of the control rod and the support tube, so as to limit an extension length of the control rod.

10. The cleaning device according to claim 1, wherein when the support portion is sleeved on the outer side of the control rod, a bearing is provided in the connection body, and the installation assembly comprises a support tube, one end of the support tube is inserted into the bearing and the other end of the support tube is inserted into the support portion; the control rod is inserted into the support tube and is movable relative to the support tube, the fixing element passes through the support tube and is provided between the control rod and the support portion to form a connection of the control rod, the support tube and the support portion.

11. The cleaning device according to claim 1, wherein when the support portion is sleeved on the outer side of the control rod, the fixing element is configured as a spherical structure.

12. The cleaning device according to claim 1, wherein when the support portion is sleeved on the outer side of the control rod, the control rod is provided with a plurality of the fixing elements around its circumferential direction, and when the control rod moves towards the support portion, the fixing elements are disengaged from the support portion.

13. The cleaning device according to claim 10, wherein a third protrusion is provided on the outer side of the control rod, and a fourth protrusion is provided on an inner side of the support tube; a spring is sleeved on the outer side of the control rod, one end of the spring abuts against the third protrusion, and the other end of the spring abuts against the fourth protrusion, so that the control rod can be reset by the spring after moving relative to the support tube.

14. The cleaning device according to claim 9, wherein the support tube is provided with an accommodation port at least equal to a diameter of the fixing element, and a snap ring is also provided on an outer side of the support tube, and the snap ring is embedded between the support tube and the fixing element, so as to prevent the fixing element from coming out towards the outer side of the support tube.

15. The cleaning device according to claim 10, wherein the support tube is configured to comprise a fixing section and a connection section connected with the fixing section, the fixing section is configured as a cylindrical structure and passes through the bearing and is fixed with the bearing, and the connection section is configured as a square structure, and the support portion is configured with a square notch, and the connection section is detachably inserted into the square notch and connected with the support portion through the fixing element.

16. The cleaning device according to claim 11, wherein the support portion is configured with a bayonet for accommodating a part of the fixing element, so that when the fixing element is connected with the support portion, the part of the fixing element is clamped in the bayonet, so as to prevent disengagement from the support portion.

17. The cleaning device according to claim 11, wherein a fixing ring is provided in the support portion, the control rod penetrates through and is provided in the fixing ring, the fixing ring is configured to be made of a metal material, and the fixing ring is configured with a bayonet for accommodating a part of the fixing element, so that when the fixing element is connected with the support portion, the part of the fixing element is clamped in the bayonet, so as to prevent disengagement from the support portion;

wherein the bayonet is configured as an arc-shaped notch provided on one side or both sides of the fixing ring.

18. A floor brush assembly, comprising:

a base; and a rolling brush assembly, wherein the rolling brush assembly comprises a rolling brush body and a support portion provided on a side of the rolling brush body, and the support portion is connected with the base through a connection assembly;

wherein the connection assembly comprises a connection body, one end of the connection body is connected with the base, and the other end of the connection body is connected with the support portion through an installation assembly, and the support portion is rotatably provided relative to the installation assembly;

wherein the installation assembly comprises a control rod, and the support portion is configured to be separated from the installation assembly when the control rod moves along its axial direction towards the support portion;

wherein the installation assembly further comprises a fixing element; and wherein:

the support portion is sleeved on an outer side of the control rod, the fixing element is provided between the support portion and the control rod, and when the control rod displaces towards the support portion, the fixing element is disengaged from the support portion; or the support portion is connected with the control rod, the fixing element is connected with the support portion, and when the control rod displaces towards the support portion, an end of the control rod connected with the support portion contracts inward and deforms, so as to realize its disengagement from the support portion.

* * * * *